US008202060B2

(12) United States Patent
Picouet

(10) Patent No.: US 8,202,060 B2
(45) Date of Patent: Jun. 19, 2012

(54) COMPRESSOR HAVING A HIGH PRESSURE SLIDE VALVE ASSEMBLY

(75) Inventor: Jean Louis Picouet, Waukesha, WI (US)

(73) Assignee: Vilter Manufactring LLC, Cudahy, WI (US)

( * ) Notice: Subject to any disclaimer, the term of this patent is extended or adjusted under 35 U.S.C. 154(b) by 1059 days.

(21) Appl. No.: 12/054,527

(22) Filed: Mar. 25, 2008

(65) Prior Publication Data

US 2008/0240939 A1 Oct. 2, 2008

Related U.S. Application Data

(60) Provisional application No. 60/908,770, filed on Mar. 29, 2007.

(51) Int. Cl.
*F04B 49/00* (2006.01)

(52) U.S. Cl. ..... 417/213; 417/310; 418/195; 418/201.2

(58) Field of Classification Search ..... 417/207, 417/213, 310; 418/201.2, 270, 201.1
See application file for complete search history.

(56) References Cited

U.S. PATENT DOCUMENTS

| | | | | |
|---|---|---|---|---|
| 774,551 | A | 11/1904 | Beaumont | |
| 3,088,659 | A | 5/1963 | Nilsson et al. | |
| 3,108,740 | A | 10/1963 | Schibbye | |
| 3,151,806 | A | 10/1964 | Whitfield | |
| 3,314,597 | A | 4/1967 | Schibbye | |
| 3,756,753 | A * | 9/1973 | Persson et al. | 418/9 |
| 3,810,715 | A * | 5/1974 | Week et al. | 417/213 |
| RE29,283 | E | 6/1977 | Shaw | |
| 4,261,691 | A | 4/1981 | Zimmern et al. | |
| 4,455,131 | A | 6/1984 | Werner-Larsen | |
| 4,478,054 | A | 10/1984 | Shaw et al. | |
| 4,583,373 | A | 4/1986 | Shaw | |
| 4,597,726 | A | 7/1986 | Soderlulnd et al. | |

(Continued)

FOREIGN PATENT DOCUMENTS

JP 55096392 A * 7/1980

(Continued)

OTHER PUBLICATIONS

PCT Notification of Transmittal of the International Search Report and the Written Opinion of The International Searching Authority, or the Declaration, mailed Aug. 4, 2008 for International Patent Application PCT/US2008/058115, filed on Mar. 25, 2008.

(Continued)

*Primary Examiner* — Devon C Kramer
*Assistant Examiner* — Ryan Gatzemeyer
(74) *Attorney, Agent, or Firm* — Whyte Hirschboeck Dudek S.C.

(57) ABSTRACT

A compressor having a high pressure slide valve assembly is disclosed. The slide valve assembly includes: a volume slide valve mechanism, the mechanism slidably movable to control compressor volume ratio and power input to the compressor. The assembly also includes a capacity slide valve mechanism that is in operational association with the volume slide valve mechanism, the capacity slide valve mechanism slidably movable to control compressor capacity. At least one of the volume slide valve mechanism and the capacity slide valve mechanism includes at least one groove or channel, and the at least one groove or channel provides for lubrication to ensure relative movement between the slide mechanisms in a high pressure environment. A method of controlling compressor volume ratio, power input and capacity in a compressor operating in a high pressure environment is also disclosed.

20 Claims, 3 Drawing Sheets

U.S. PATENT DOCUMENTS

| | | | | |
|---|---|---|---|---|
| 4,610,612 | A * | 9/1986 | Kocher | 418/195 |
| 4,610,613 | A * | 9/1986 | Szymaszek | 418/195 |
| 4,611,976 | A | 9/1986 | Schibbye et al. | |
| 4,704,069 | A * | 11/1987 | Kocher et al. | 417/53 |
| 4,842,501 | A | 6/1989 | Schibbye et al. | |
| 5,435,704 | A * | 7/1995 | Sawyer | 418/201.2 |
| 7,798,793 | B2 * | 9/2010 | Shoulders | 418/201.2 |
| 7,891,955 | B2 * | 2/2011 | Picouet | 417/213 |
| 2006/0008375 | A1 | 1/2006 | Hasegawa | |
| 2008/0206075 | A1 | 8/2008 | Picouet | |
| 2010/0284848 | A1 * | 11/2010 | Fujiwara et al. | 418/201.1 |

FOREIGN PATENT DOCUMENTS

| | | | |
|---|---|---|---|
| JP | 57195889 | A * | 12/1982 |
| JP | 04063986 | A * | 2/1992 |
| JP | 04063987 | A * | 2/1992 |
| WO | 2006085866 | A1 | 8/2007 |

OTHER PUBLICATIONS

The First Office Action pertaining to PCT Application entering Chinese National Phase, Application No. 200880017517.4, Issuing No. 2011042200501020, Issuing Date: Apr. 27, 2011 (7 pgs.).

PCT Notification of Transmittal of the International Search Report and the Written Opinion of the International Searching Authority, mailed Dec. 20, 2007 for International Patent Application PCT/US2007/05042, filed on Feb. 26, 2007.

* cited by examiner

COMPRESSOR HAVING A HIGH PRESSURE SLIDE VALVE ASSEMBLY

CROSS-REFERENCE TO RELATED APPLICATIONS

This Nonprovisional patent application claims the benefit under 35 USC §119(e) of U.S. Provisional Application No. 60/908,770 filed Mar. 29, 2007, which is incorporated herein by reference.

FIELD OF THE INVENTION

This invention relates generally to compressors and to adjustably positionable slide valves used in such compressors to control their operation. In one aspect, the invention relates to an improved slide valve assembly having independently positionable slide valves for regulating both compressor capacity and compressor volume in a high pressure environment.

BACKGROUND OF THE INVENTION

Compressors (e.g., rotary screw gas compressors) are used, for example, in compression systems (e.g., refrigeration systems) to compress refrigerant gas, such as "Freon", ammonia, natural gas, or the like. One type of rotary gas compressor employs a housing in which a motor-driven single main rotor having spiral grooves thereon meshes with a pair of gate or star rotors on opposite sides of the rotor to define gas compression chambers. The housing is provided with two gas suction ports (one near each gate rotor) and with two gas discharge ports (one near each gate rotor). Two dual slide valve assemblies are provided on the housing (one assembly near each gate rotor) and each slide valve assembly comprises a suction (also referred to as a "capacity slide valve") and a discharge slide valve (also referred to as a "volume slide valve") for controlling an associated suction port and an associated discharge port, respectively.

During operation of the compressor, a small amount of oil is typically continuously supplied to the compression chambers to provide an oil seal at points where the main rotor meshes with the gate rotors and with the housing to thereby effectively seal the chambers against gas leakage during gas compression. The oil flows out through the discharge ports and is recovered and recirculated. When the compressor is shut down and coasting to rest, excess oil can collect or settle in the compression chambers. When the compressor is restarted, the residual oil in the compression chambers, plus fresh oil entering the compression chambers, must be expelled through the discharge ports. U.S. Pat. Nos. 4,610,612, 4,610,613 and 4,704,069, all of which are assigned to the same assignee as the present application, disclose a dual-slide valve rotary gas compressor of the kind described above. The teachings and disclosures of each of these patents are incorporated by reference in their entireties herein.

Additionally, U.S. application Ser. No. 11/677,868 which is also assigned to the same assignee as the present application is directed to a compressor having a dual slide valve assembly that includes: i) a volume slide valve mechanism that is slidably movable to control compressor volume ratio and power input to the compressor; and ii) a capacity and volume slide valve mechanism that is in operational association with the volume slide valve mechanism. The capacity and volume slide valve mechanism is slidably movable to control compressor capacity and to control volume ratio and power input to the compressor. The disclosure of this application is also incorporated by reference here in its entirety.

The electric motors or engines employed to drive rotors in rotary compressors are usually of a type which requires the compressor to be unloaded while being started and brought up to some predetermined normal constant speed. Loading and unloading is accomplished by positioning of slide valves which control admission and discharge of gas into and from the compression chambers.

Often a discharge-suction pressure differential exists within the compressor during operation. When the discharge-suction pressure differential reaches and/or exceeds a certain threshold differential, the slide valve mechanisms can have a tendency to seize up and, in some instances, be damaged. For example, it has been found that certain screw-type compressors (e.g., single screw compressors) currently have threshold discharge-suction pressure differentials of about 400 p.s.i. Accordingly, it would desirable to provide a compressor, and more particularly a slide valve assembly, that can function in a high pressure environment, for example, when threshold pressure differentials are at or exceed about 400 p.s.i.

BRIEF DESCRIPTION OF THE DRAWINGS

Embodiments of the invention are disclosed with reference to the accompanying drawings and are for illustrative purposes only. The invention is not limited in its application to the details of construction or the arrangement of the components illustrated in the drawings. The invention is capable of other embodiments or of being practiced or carried out in other various ways. Like reference numerals are used to indicate like components. In the drawings.

DETAILED DESCRIPTION OF THE PREFERRED EMBODIMENT(S)

Figure 1:
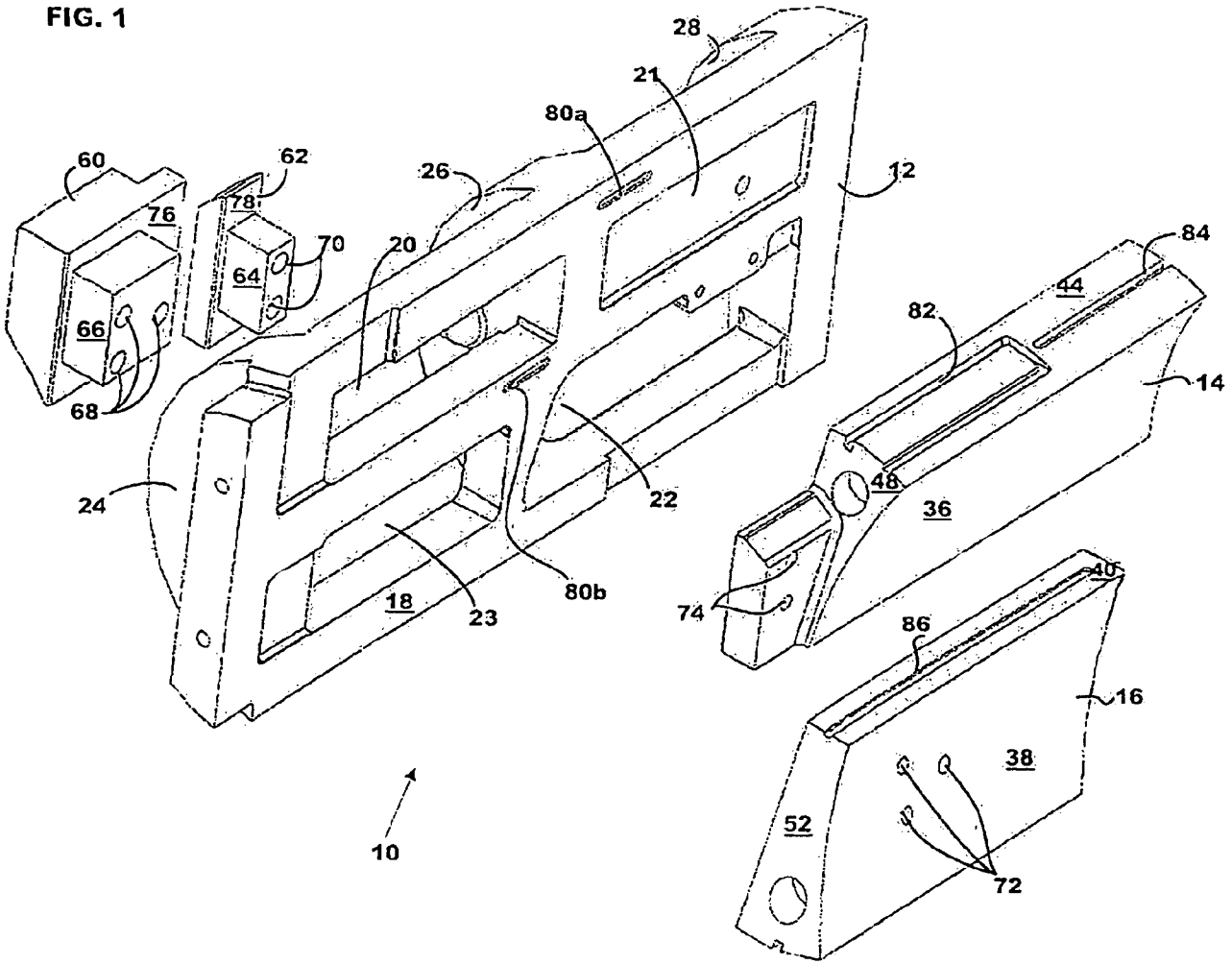
FIG. 1 is a top exploded perspective view of a high pressure slide valve assembly for use in a compressor in accordance with at least some embodiments of the present invention.
Figure 2:
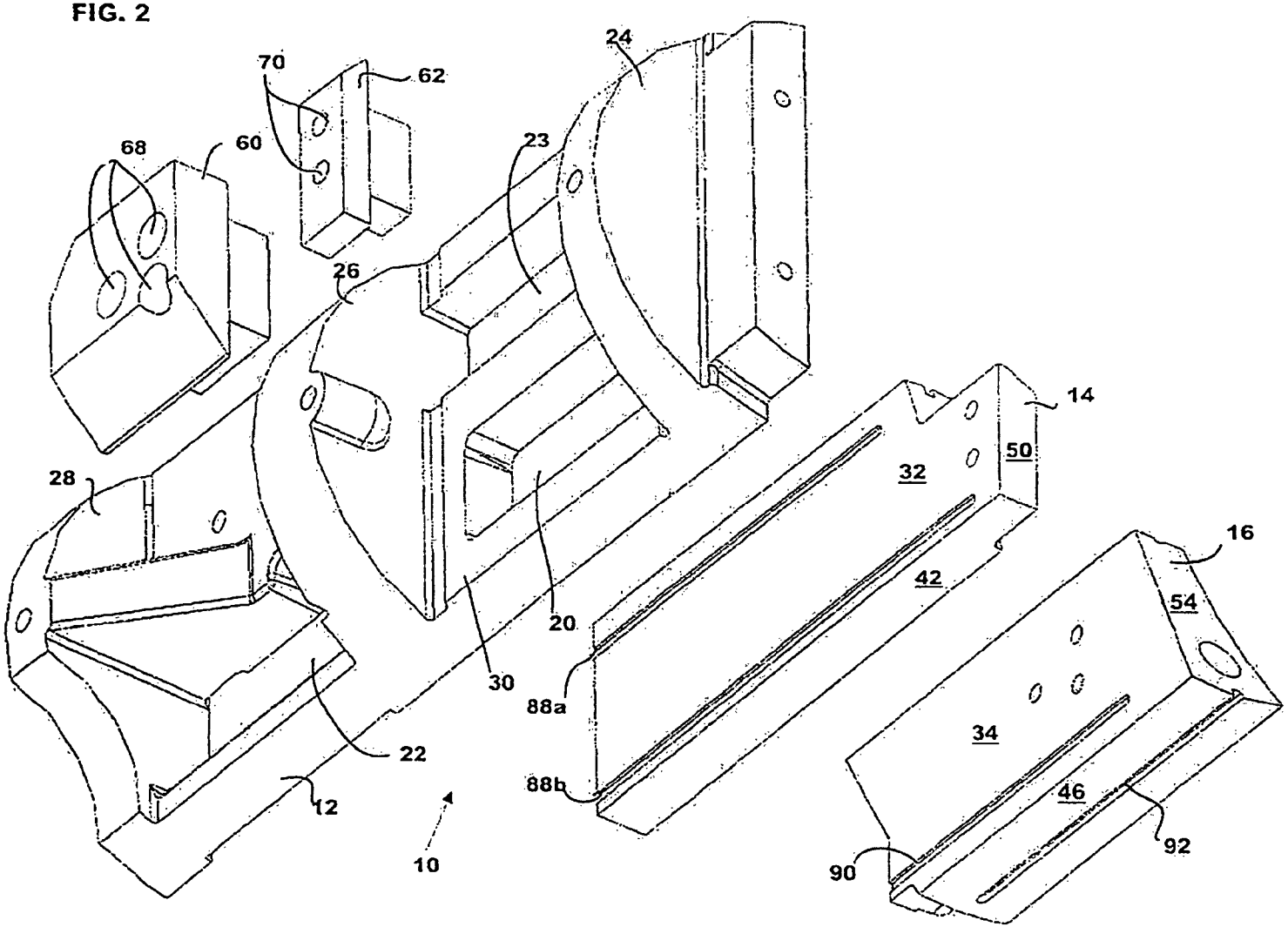
FIG. 2 is a bottom exploded perspective view of the slide valve assembly of FIG. 1.

Referring generally to FIGS. 1 and 2, and in accordance with at least some embodiments of the present invention, top and bottom exploded perspective views of a high pressure slide valve assembly 10 for use in a compressor are shown. By way of introduction, it should be understood that the slide valve assembly 10 is contemplated for use in a variety of compressors. One exemplary compressor is a rotary screw gas compressor adapted for use in a compression system (e.g., a refrigeration system), or the like. Such a compressor generally has a compressor housing, a single main rotor mounted for rotation in housing, and a pair of star-shaped gate or star rotors mounted for rotation in housing and engaged with main rotor. The compressor typically further includes two such slide valve assemblies (noted by numeral 10) which are generally mounted inside the housing and which are cooperable with the main rotor to control gas flow into and from the compression chambers on the main rotor. The compressor housing generally includes a cylindrical bore in which the main rotor is rotatably mounted. The bore is usually open at its suction end and is generally closed by a discharge end wall. The main rotor, which is generally cylindrical and typically has a plurality of helical grooves formed therein defining compression chambers, is provided with a rotor shaft which is rotatably supported at opposite ends on bearing assemblies mounted on housing. The compressor housing typically includes spaces therein in which the star rotors are rotatably mounted and the star rotors are located on opposite sides (i.e., 180 degrees apart) of main rotor. Each of the star rotors has a plurality of gear teeth and is provided with a rotor shaft which is rotatably supported at opposite ends on the bearing assemblies mounted on housing. Each of the star rotors typically rotate on an axis which is perpendicular to and spaced from the axis of rotation of main rotor and its teeth extend through an opening communicating with bore. Each tooth of each of the star rotors successively engages a groove in main rotor as the latter is rotatably driven by a motor and, in cooperation with the wall of bore and specifically its end wall, defines a gas compression chamber.

Referring to FIGS. 1 and 2, the slide valve assembly 10 comprises a slide valve carriage 12 and further comprises two movable slide valve members or mechanisms, namely, a capacity slide valve member 14 and a volume slide valve member 16. Slide valve members 14 and 16 are slidably mounted on carriage 12 for movement in directions which are typically parallel to the axis of the compressor main rotor (not shown). Carriage 12 comprises a rectangular plate portion 18 (FIG. 1) having three openings 20, 22 and 23, as well as a relief or recessed portion 21. Three spaced apart projections 24, 26, and 28 extend from the rear side 30 (FIG. 2) of plate portion 18 (FIG. 1) of carriage 12. These projections serve to support the carriage, and in addition, projection 26 serves to separate gas flow between high pressure and low pressure gas flow. Openings 20 and 23 in carriage 12 are in communication with a gas inlet passage and opening 22 in carriage 12 is in communication with a gas exhaust passage, and in at least some embodiments of the present invention, such communication for each opening can be termed "direct communication".

The slide valve members 14 and 16 each take the form of a structural body having a flat smooth rear surface 32 and 34 (FIG. 2), respectively. Each of the members 14 and 16 further include a curved or contoured, yet smooth or substantially smooth, front surface 36 and 38 (FIG. 1) respectively. The slide valve members further include inside surfaces 40 (FIG. 1) and 42 (FIG. 2), which are typically flat and smooth or substantially smooth, as well as outside surfaces 44 (FIG. 1) and 46 (FIG. 2), which are typically contoured or curved and smooth or substantially smooth. Capacity slide valve member 14 includes end surfaces 48 (FIG. 1) and 50 (FIG. 2) and volume slide valve member 16 includes end surfaces 52 (FIG. 1) and 54 (FIG. 2).

Rear surfaces 32 and 34 confront and slide upon plate portion 18 carriage 12. Front surfaces 36 and 38 confront the cylindrical surface of main rotor (not shown). The inside edges 40 and 42 of the slide valve members 14 and 16 slidably engage each other. The outside edges 44 and 46 of the slide valve members confront and slidably engage a compressor structure, such as bore (not shown). The slide valve members 14 and 16 are slidably secured to carriage 12 by volume clamping member 60 and capacity clamping member 62, respectively, which are secured to the slide valve members by screws (not shown). The volume and capacity clamping members 60 and 62 have shank or spacer portions 64 and 66, respectively. These spacer portions extend, respectively, through the openings 20 and 23 in carriage 12 and abut the rear surfaces 32 and 34 of the slide valve members 14 and 16, respectively. Screws or other fastening means (not shown) extend through holes 68 and 70 in the clamping members 60 and 62 and screw or otherwise fasten into threaded holes 72 and 74 slide valve members 14 and 16. The clamping members 60 and 62 have heads or flanges 76 and 78, respectively, which engage the rear side 30 of carriage 12. Advantageously, it has been found that, in accordance with at least some embodiments, the clamping mechanisms 60, 62 can be made from 1018 4140 heat treated steel to accomplish use of the slide valve assembly in high pressure applications.

Referring to FIG. 1, carriage mechanism 12 further includes carriage grooves or channels 80*a* and 80*b* respectively which are formed or otherwise created in the plate portion 18 of the carriage. Capacity slide valve 14 further includes an outside low pressure groove 82 an outside high pressure groove 84, both of which are formed in the outside surface 44 of the capacity slide valve. The capacity low pressure groove 82 is, in at least some embodiments and as shown, at least somewhat "unshaped", and the high pressure groove is, in at least some embodiments and as shown, substantially straight. Grooves 82 and 84 are spaced apart from each other at about the center of the outside surface 44 of the capacity slide valve member 14. Volume slide valve member 16 includes a volume low pressure groove 86 which is formed or otherwise created in the inside surface 40 of the slide member. The groove 86 extends from end 52 across almost the entire extent of the inside surface 40 of the volume slide member 16.

Referring to FIG. 2, capacity slide valve member 14 further includes a pair of high pressure bottom grooves 88*a* and 88*b* which are formed or otherwise created in the rear surface 32 of the capacity slide valve member. Grooves 88*a* and 88*b* extend across almost the entire extent of the rear surface 32 of the capacity slide valve member 14. Volume slide valve member 16 further includes a volume high pressure bottom groove 90. Groove or channel 90 is formed in, and extends across almost the entire extent of, the rear surface 34 of the volume slide valve member 16. Finally, the volume slide valve member 16 includes a volume low pressure outside groove 92 that is formed or otherwise created in, and extends across almost the entire extent of, outside surface 46 of the volume slide valve member.

The grooves referenced above which are formed or otherwise positioned or created in the capacity and volume slide valve mechanisms provide for lubrication of and between contacting surfaces and are incorporated to counter or counteract pressure of an opposing surface(s). Accordingly, the grooves serve to provide for and ensure relative movement between the slide mechanisms (and thus, prevent seizing up of the slide mechanisms) in a high pressure environment.

While not shown, the assembly 10 can be moved via an actuator-gear-rod connection. More specifically, an actuator mechanism can be used to effect the slide valve movement via a gear that moves a slide rod. In at least some embodiments, the gear mechanism comprises a pinion gear and the rod mechanism comprises a slide rod. Further, in at least some embodiments, the actuator/motor mechanism comprises a piston-type (e.g., electrical or hydraulic) actuator mechanism.

When the compressor is operating (and again a compressor will typically include two of the above-described slide valve assemblies), the capacity slide valve members 14 typically move in unison with each other, and the volume slide valve members 16 typically move in unison with each other. Each capacity slide valve member 14 is slidably positionable (between full load and part load positions) relative to the port 20 to control where low pressure uncompressed gas is admitted to the compressor compression chambers or main rotor grooves and to thereby function as a suction by-pass to control compressor capacity. Each volume slide valve member 16 is slidably positionable (between minimum and adjusted volume ratio positions) relative to the discharge/volume port 22 to control where, along the compressor compression chambers or grooves, high pressure compressed gas is expelled from the compression chambers, through discharge/volume port 22 to an gas exhaust passage to thereby control the input power to the compressor. The slide valve members 14 and 16 are independently movable, for example, by separate piston-type actuators/motors. And known control means or system(s) operate to position the slide valves 14 and 16 for compressor start-up. The control means or system is also responsive, while the compressor is running, to compressor capacity and to power input, which is related to the location of the slide valves 14 and 16. Additionally, the control means or system operates the actuators to position the slide valve members 14 and 16 to cause the compressor to operate at a predetermined capacity and a predetermined power input.

Importantly, the slide valve members or mechanisms 14 are capable of adjusting the capacity between about 100% and 10%. The slide valve members or mechanisms 16 are capable of adjusting the volume ratio between about 1.2 to 7.0 so that power required by the compressor to maintain the desired capacity is at a minimum.

Figure 3A:
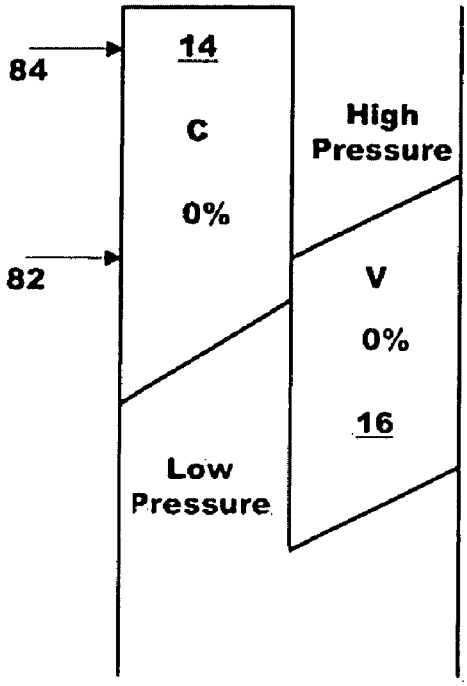
FIGS. 3A-B are schematic views showing relative positioning of the capacity and volume slide valves at start-up and during running/operation of the compressor.
Figure 3B:
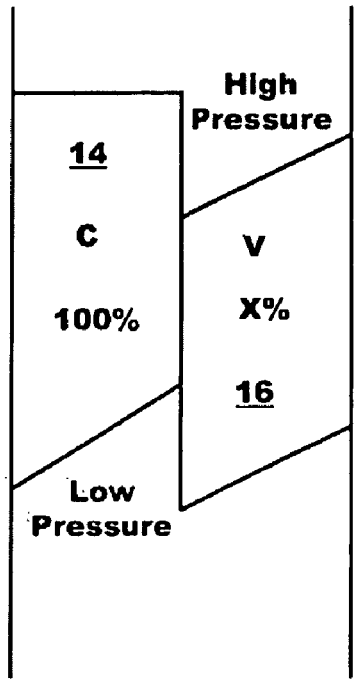

FIGS. 3A-B are schematic views showing relative positioning of the capacity and volume slide valves at start-up and during running/operation of the compressor. With reference to these Figures and FIGS. 1-2 described above, several points are worthy of mention. When the capacity slide valve 14 capacity is at 0%, capacity high pressure bottom grooves 88*a-b* are in communication with carriage grooves 80*a-b*. This permits or allows the compressor oil/gas mixture in the grooves to leak or otherwise flow to a low pressure area (indicated in the schematic views). This in turn prevents, or at least substantially prevents, any hard particles (e.g., dirt, debris, etc.) from getting in between the capacity slide valve mechanism 14 and the carriage 12. Once the capacity slide valve reaches a certain pre-determined capacity (i.e., the capacity takes on a load), for example a 5% capacity or load, the capacity slide valve grooves 88*a-b* will no longer remain in communication with the carriage grooves 80*a-b*. As shown, and as noted above, the capacity slide valve 14 further includes a pair of outside grooves 82 and 84. Again, groove 82 is a capacity outside low pressure groove and groove 84 is a capacity outside high pressure groove. The location of grooves 82 and 84 is generally indicated as well in the schematic views of FIGS. 3A-B. Groove 84 is in communication with a high pressure region and groove 82 is in communication with a low pressure region (again the low and high pressure regions are schematically illustrated). Groove 84 is in communication with the high pressure region because the capacity slide valve member surface 36 remains (and this is typically always) under a high pressure condition when the capacity slide valve moves between 0-100% load.

Advantageously, the slide valve mechanisms work or operate in a high pressure differential environment. For example, compressor discharge pressure is in a range of between about 500 to 600 psi, or even greater, and suction pressure is typically between about 200 to 300 psi, or even greater. Accordingly, the slide valve assembly of the present invention is contemplated to work or operate where there is a discharge-suction pressure differential of at least about 400 psi. Testing has confirmed proper functionality where the pressure differential is at or about 450 psi. It is contemplated that the proper functionality will be maintained at pressure differentials of up to about 800 psi, and perhaps even greater.

Various components can be provided to connect together the capacity and volume slide valve members of the two dual slide valve assemblies and so that volume slide valve members move in unison with each other when slide to appropriate and/or desired positions.

Components, assemblies and/or means are provided and/or described in accordance with the present invention to establish the start-up positions of the slide valves and, to relocate them in desired positions suitable for the load condition desired when the compressor is up to speed, and to determine the positions for the slide valves and which would provide the most efficient volume ratio for the selected load condition. These means, assemblies, etc., could, for example, take the form of or include a microprocessor circuit (not shown) in the controller which mathematically calculates these slide valve positions, or they could take the form of or include pressure sensing devices.

It should also be noted that in the preferred embodiment disclosed herein the two valve members (on opposite sides of the rotor) are typically moved in synchronism with each other and the two valve members (on opposite sides of the rotor) are moved in synchronism with each other so as to provide for "symmetric" unloading of the compressor. However, each slide valve member in a pair can be moved independently of the other so as to provide for "asymmetrical" unloading of the compressor, if appropriate linkages (not shown) are provided and if the control system is modified accordingly in a suitable manner.

Again, many other variations to the compressor dual slide valve assembly, its components, and the compressor in which it is utilized are possible and considered within the scope of the claims. For example, it is contemplated that the compressor gases themselves at various points in the system, could be used directly to effect positioning of the slide valves and, if suitable structures (not shown) are provided. Moreover, the holes, ports, channels, and the like can be sized and shaped depending on the compressor type and application at hand. Similarly, the size and shape of structural or mechanical components shown and/or described herein can be varied without departing from the scope of the present invention.

Accordingly, it is specifically intended that the present invention not be limited to the embodiments and illustrations contained herein, but include modified forms of those embodiments including portions of the embodiments and combinations of elements of different embodiments as come within the scope of the following claims.

I claim:

1. A compressor comprising:

a housing;

a high pressure slide valve assembly positioned at least substantially within the housing, the assembly comprising:

a carriage mechanism;

a volume slide valve mechanism secured to the carriage mechanism and movable to control compressor volume ratio and power input to the compressor, the volume slide valve mechanism including a first surface having a volume low pressure groove, a second surface having a volume high pressure groove; and a third surface having a volume low pressure groove; and a capacity slide valve mechanism that is secured to the carriage and is in operational association with the volume slide valve mechanism, the capacity slide valve mechanism movable to control compressor capacity, the capacity slide valve mechanism including a first surface a second surface having a pair of capacity high pressure grooves; and a third surface having a capacity high pressure groove and a capacity low pressure groove;

wherein at least one of the grooves of the volume slide valve mechanism and the capacity slide valve mechanism counter pressure and provide lubrication including an oil and gas mixture, to ensure movement of and between the volume and capacity slide valve mechanisms in a high pressure environment.

2. The compressor of claim 1 wherein the capacity slide valve mechanism first surface is an opposing surface that opposes or faces and contacts, so as to confront and engage, the first surface of the volume slide valve mechanism having the volume low pressure groove.

3. The compressor of claim 2 wherein each of the grooves of both the capacity slide valve mechanism and the volume slide valve mechanism ensure relative movement in the high pressure environment.

4. The compressor of claim 1 wherein the third surface in which the capacity slide valve mechanism high and low pressure grooves are formed is an outside surface of the capacity slide valve mechanism.

5. The compressor of claim 4 wherein the capacity slide valve mechanism low pressure groove is at least somewhat u-shaped and the capacity slide valve mechanism high pressure groove is at least substantially straight.

6. The compressor of claim 4 wherein the second surface in which the pair of capacity high pressure grooves are formed or otherwise created is in a rear surface of the capacity slide valve mechanism.

7. The compressor of claim 1 wherein the first surface in which the volume low pressure groove is formed or otherwise created is in an inside surface of the volume slide mechanism.

8. The compressor of claim 7 wherein the volume slide valve mechanism high pressure groove is a volume high pressure bottom groove.

9. The compressor of claim 8 wherein the third surface in which the volume slide valve mechanism low pressure groove is formed or otherwise created is an outside surface of the volume slide valve mechanism.

10. The compressor of claim 1 wherein the volume slide valve mechanism and the capacity and volume slide valve mechanism are independently movable.

11. The compressor of claim 1 wherein the compressor is a rotary gas compressor for a compression system and the compressor further comprises a helically grooved main rotor having a rotor axis and the main rotor is mounted for rotation about the rotor axis within the housing, and further wherein each of the slide valve mechanisms includes a face complementary to and confronting said main rotor in sliding sealed relationship.

12. The compressor of claim 1 wherein the carriage mechanism includes one or more carriage grooves which are formed or otherwise created in a plate portion of the carriage mechanism, and one or more of capacity slide valve mechanism grooves are, for at least a period of time during operation of the compressor, in communication with the one or more carriage grooves.

13. A high pressure slide valve assembly for use in a compressor, the assembly comprising:

a carriage mechanism;

a volume slide valve mechanism secured to the carriage mechanism and movable to control compressor volume ratio and power input to the compressor, the volume slide valve mechanism including a first surface having a volume low pressure groove, a second surface having a volume high pressure groove; and a third surface having a volume low pressure groove; and a capacity slide valve mechanism that is secured to the carriage and is in operational association with the volume slide valve mechanism, the capacity slide valve mechanism movable to control compressor capacity, the capacity slide valve mechanism including a first surface, a second surface having a pair of capacity high pressure grooves; and a third surface having a capacity high pressure groove and a capacity low pressure groove;

wherein at least one of the grooves of the volume slide valve mechanism and the capacity slide valve mechanism counter pressure and provide lubrication including an oil and gas mixture, to ensure movement of and between the volume and capacity slide valve mechanisms in a high pressure environment.

14. A method of controlling compressor volume ratio, power input and capacity in a compressor operating in a high pressure environment, the method comprising:

providing a high pressure slide valve assembly comprising a carriage mechanism that includes one or more carriage grooves which are formed or otherwise created in a plate portion of the carriage mechanism, a volume slide valve mechanism, and a capacity slide valve mechanism that is in operational association with the volume slide valve mechanism, at least one of the volume and capacity slide valve mechanisms connectable to the carriage mechanism, the volume slide valve mechanism including a first surface having a volume low pressure groove, a second surface having a volume high pressure groove; and a third surface having a volume low pressure groove, the capacity slide valve mechanism including a first surface, a second surface having a pair of capacity high pressure grooves; and a third surface having a capacity high pressure groove and a capacity low pressure groove, the volume slide valve mechanism and the capacity slide valve mechanism countering pressure and providing lubrication including an oil and gas mixture, to ensure movement of and between the volume and capacity slide valve mechanisms in a high pressure environment;

moving at least one of: a) the volume slide valve mechanism to control compressor volume ratio and power input to the compressor; and b) the capacity slide valve mechanism to control compressor capacity, wherein the moving takes place in a high pressure environment.

15. The method of claim 14 wherein the high pressure environment comprises a suction-discharge pressure differential of at least 400 p.s.i.

16. The method of claim 14 wherein, during the moving, one or more of the capacity slide valve mechanism grooves are, for at least a period of time during operation of the compressor, in communication with the one or more carriage grooves.

17. The assembly of claim 13 wherein: (i) the capacity slide valve mechanism first surface is an opposing surface that opposes or faces and contacts, so as to confront and engage, the first surface of the volume slide valve mechanism having the volume low pressure groove; and (ii) each of the grooves of both the capacity slide valve mechanism and the volume slide valve mechanism ensure relative movement in the high pressure environment.

18. The assembly of claim 13 wherein: (i) the third surface in which the capacity slide valve mechanism high and low pressure grooves are formed is an outside surface of the capacity slide valve mechanism; (ii) the capacity slide valve mechanism low pressure groove is at least somewhat u-shaped and the capacity slide valve mechanism high pressure groove is at least substantially straight; and (iii) the second surface in which the pair of capacity high pressure grooves are formed or otherwise created is in a rear surface of the capacity slide valve mechanism.

19. The compressor of claim 13 wherein: (i) the first surface in which the volume low pressure groove is formed or otherwise created is in an inside surface of the volume slide mechanism; (ii) the volume slide valve mechanism high pressure groove is a volume high pressure bottom groove; and (iii) the third surface in which the volume slide valve mechanism low pressure groove is formed or otherwise created is an outside surface of the volume slide valve mechanism.

20. The compressor of claim 13 wherein the volume slide valve mechanism and the capacity and volume slide valve mechanism are independently movable.

* * * * *

UNITED STATES PATENT AND TRADEMARK OFFICE

CERTIFICATE OF CORRECTION

PATENT NO. : 8,202,060 B2
APPLICATION NO. : 12/054527
DATED : June 19, 2012
INVENTOR(S) : Jean-Louis Picouet It is certified that error appears in the above-identified patent and that said Letters Patent is hereby corrected as shown below:

Column 8, line 35: After "groove," insert --and at least one of the grooves of--

Signed and Sealed this
Eleventh Day of September, 2012

David J. Kappos

David J. Kappos
*Director of the United States Patent and Trademark Office*